US009156669B2

(12) United States Patent
Conforti et al.

(10) Patent No.: US 9,156,669 B2
(45) Date of Patent: Oct. 13, 2015

(54) LIQUID BOTTLING METHOD AND MACHINE, IN PARTICULAR FOR CARBONATED LIQUIDS OR OXYGEN SENSITIVE LIQUIDS

(75) Inventors: Lucio Conforti, Parma (IT); Stefano Baini, Parma (IT)

(73) Assignee: SIDEL S.p.A. (IT)

( * ) Notice: Subject to any disclaimer, the term of this patent is extended or adjusted under 35 U.S.C. 154(b) by 943 days.

(21) Appl. No.: 13/380,017

(22) PCT Filed: Oct. 26, 2009

(86) PCT No.: PCT/EP2009/064097

§ 371 (c)(1),
(2), (4) Date: Apr. 12, 2012

(87) PCT Pub. No.: WO2010/149233

PCT Pub. Date: Dec. 29, 2010

(65) Prior Publication Data

US 2012/0187073 A1 Jul. 26, 2012

(30) Foreign Application Priority Data

Jun. 26, 2009 (WO) ..... PCT/IT2009/000283

(51) Int. Cl.
*B65D 41/00* (2006.01)
*B67C 7/00* (2006.01)
(Continued)

(52) U.S. Cl.
CPC ..... *B67C 7/00* (2013.01); *B65D 51/228* (2013.01); *B67B 3/00* (2013.01); *B67B 3/22* (2013.01);
(Continued)

(58) Field of Classification Search
CPC ..... B67B 3/02; B67B 3/06; B67B 3/10; B65B 3/04; B65B 7/16; B65B 7/28; B65B 31/04; B65B 31/043; B65B 31/00; B64D 41/00; B67C 7/00
USPC ..... 215/316; 141/147, 183, 372; 53/248.5, 53/248.6, 471, 488, 473
See application file for complete search history.

(56) References Cited

U.S. PATENT DOCUMENTS 1,882,860 A * 10/1932 Mohler ..... 53/269
2,885,845 A * 5/1959 Ryan, Jr. ..... 53/510
(Continued)

FOREIGN PATENT DOCUMENTS

DE 3927491 A1 2/1991
DE 19538023 A1 4/1996
(Continued)

OTHER PUBLICATIONS

"International Application Serial No. PCT/EP2009/064097, International Search Report mailed Mar. 25, 2010", 5 pgs.
(Continued)

*Primary Examiner* — Gloria R Weeks
*Assistant Examiner* — Eduardo R Ferrero
(74) *Attorney, Agent, or Firm* — Schwegman Lundberg & Woessner, P.A.

(57) ABSTRACT

A method of bottling liquids, in particular carbonated liquids or liquids sensitive to oxygen, on a machine comprising a conveying device movable along a given path and having at least one unit for receiving and retaining a bottle, the method comprising filling the bottle with a liquid as the unit travels along a first portion of the path; and capping the bottle with a cap as the same unit travels along a second portion of the path. Also, A bottle as obtained by the method and also comprising a further cap applied onto a neck of said bottle and provided with coupling means to engage and pull said cap along the bottle axis upon removal of said further cap from said neck so as to open the bottle.

16 Claims, 15 Drawing Sheets

(51) Int. Cl.

| | |
|---|---|
| ***B65D 51/22*** | (2006.01) |
| ***B67B 3/00*** | (2006.01) |
| ***B67B 3/22*** | (2006.01) |
| *B67B 3/02* | (2006.01) |
| *B67C 3/26* | (2006.01) |

(52) U.S. Cl.

CPC . *B65D 2251/0015* (2013.01); *B65D 2251/0078* (2013.01); *B67B 3/02* (2013.01); *B67C 2003/2648* (2013.01); *B67C 2007/006* (2013.01); *B67C 2007/0066* (2013.01)

(56) References Cited

U.S. PATENT DOCUMENTS

| | | | | | |
|---|---|---|---|---|---|
| 3,672,121 | A * | 6/1972 | Kawaminani | 53/351 |
| 4,102,365 | A * | 7/1978 | Jordan et al. | 141/39 |
| 4,476,987 | A * | 10/1984 | Nolan | 215/319 |
| 4,729,204 | A * | 3/1988 | Weiss | 53/88 |
| 4,872,304 | A * | 10/1989 | Thompson | 53/487 |
| 4,994,129 | A * | 2/1991 | Nakagaki | 156/69 |
| 5,111,635 | A * | 5/1992 | Neber | 53/334 |
| 5,150,558 | A * | 9/1992 | Bernhard | 53/167 |
| 5,280,693 | A * | 1/1994 | Heudecker | 53/306 |
| 5,402,623 | A * | 4/1995 | Ahlers | 53/471 |
| 6,082,418 | A * | 7/2000 | Naecker et al. | 141/145 |
| 6,477,823 | B1 * | 11/2002 | Kitterman et al. | 53/485 |
| 7,013,624 | B2 * | 3/2006 | Zwilling | 53/544 |
| 7,299,602 | B2 * | 11/2007 | Denom et al. | 53/331 |
| 7,341,079 | B2 * | 3/2008 | Zanga | 141/92 |
| 7,430,842 | B2 * | 10/2008 | De Vos | 53/449 |
| 7,469,726 | B2 * | 12/2008 | Clusserath et al. | 141/57 |
| 8,151,831 | B2 * | 4/2012 | Zanini et al. | 141/83 |
| 2005/0269283 | A1 * | 12/2005 | Ribi | 215/316 |
| 2007/0056652 | A1 * | 3/2007 | Ruppman et al. | 141/64 |
| 2007/0220835 | A1 * | 9/2007 | Till | 53/471 |
| 2007/0269624 | A1 * | 11/2007 | Granger | 428/36.7 |
| 2008/0041810 | A1 * | 2/2008 | Itoh et al. | 215/316 |
| 2008/0083694 | A1 * | 4/2008 | Ammann | 215/316 |
| 2008/0184668 | A1 * | 8/2008 | Monti | 53/53 |
| 2010/0050576 | A1 * | 3/2010 | Moller | 53/490 |
| 2012/0187073 | A1 * | 7/2012 | Conforti et al. | 215/316 |

FOREIGN PATENT DOCUMENTS

| | | | | |
|---|---|---|---|---|
| DE | 19942507 | A1 | 3/2001 | |
| DE | 19942507 | A1 * | 3/2001 | B67C 7/00 |
| DE | 19538023 | B4 * | 7/2005 | |
| DE | 102012010903 | A1 * | 12/2013 | |
| EP | 2020385 | A1 | 2/2009 | |
| GB | 1027597 | A | 4/1966 | |

OTHER PUBLICATIONS

"International Application Serial No. PCT/EP2009/064097, Written Opinion mailed Mar. 25, 2010", 6 pgs.

* cited by examiner

LIQUID BOTTLING METHOD AND MACHINE, IN PARTICULAR FOR CARBONATED LIQUIDS OR OXYGEN SENSITIVE LIQUIDS

PRIORITY CLAIM AND RELATED APPLICATIONS

This application is a nationalization under 35 U.S.C. 371 of PCT/EP2009/064097, filed Oct. 26, 2009 and published as WO 2010/149233 A1 on Dec. 29, 2010, which claims priority of PCT/IT2009/000283, filed Jun. 26, 2009, which applications and publication are incorporated herein by reference in their entirety.

TECHNICAL FIELD

The present invention relates to a method and machine for bottling liquids into bottles.

It is pointed out that, in the present description and in the claims, the term "bottle" is used to indicate any kind of container provided with a neck portion, i.e. a portion tapering to the container top end and defining a pour opening through which to pour the liquid product. In particular, the term "bottle" includes glass or plastic containers or even combined cardboard-plastic containers, having a neck or top portion made of plastic material and the remaining part made of a multilayer cardboard material.

BACKGROUND ART

The present invention may be used to particular advantage for bottling beer, or other beverages sensitive to oxygen in glass bottles, which the following description will refer to, although this is in no way intended to limit the scope of protection as defined by the accompanying claims.

In the bottling of carbonated liquid or liquid sensitive to oxygen, like beer in glass bottles, a system is known comprising a feed line for feeding a succession of empty bottles to a filling machine, in turn comprising a filling wheel, which is mounted to rotate continuously about a longitudinal axis, receives the empty bottles successively, feeds pressurized gas into the bottles, fills the bottles with beer, decompresses the full bottles, and feeds the bottles to a capping machine connected to the filling machine by at least one transfer wheel, and which closes the bottles with respective caps.

Though widely used, known bottling systems of the above type have various drawbacks.

In particular, because the liquid in the bottles comes into contact with the atmosphere, and therefore with oxygen, as the bottles are transferred from the filling machine to the capping machine, known bottling systems of the above type, to prevent oxidation and deterioration of the liquid, have the drawback of having to remove the air from the bottles by skimming the liquid before the bottles are capped, thus resulting in loss of a certain amount of liquid from each bottle. This is particularly damaging in the case of beer, which is highly oxygen-sensitive.

Moreover, comprising two machines, i.e. the filling machine and the capping machine, systems of the above type are fairly bulky, and allow little freedom of choice in terms of layout.

DISCLOSURE OF INVENTION

It is an object of the present invention to provide a liquid bottling method, in particular for carbonated liquids, designed to eliminate the aforementioned drawbacks, and which is cheap and easy to implement.

According to the present invention, there is provided a liquid bottling method, in particular for carbonated liquids, as claimed in claims 1 to 11.

The present invention also relates to a liquid bottling machine, in particular for carbonated liquids.

According to the present invention, there is provided a liquid bottling machine, in particular for carbonated liquids, as claimed in claims 12 to 20.

The present invention also relates to a bottle as obtained by the new liquid bottling method and claimed in claims 21 to 22.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
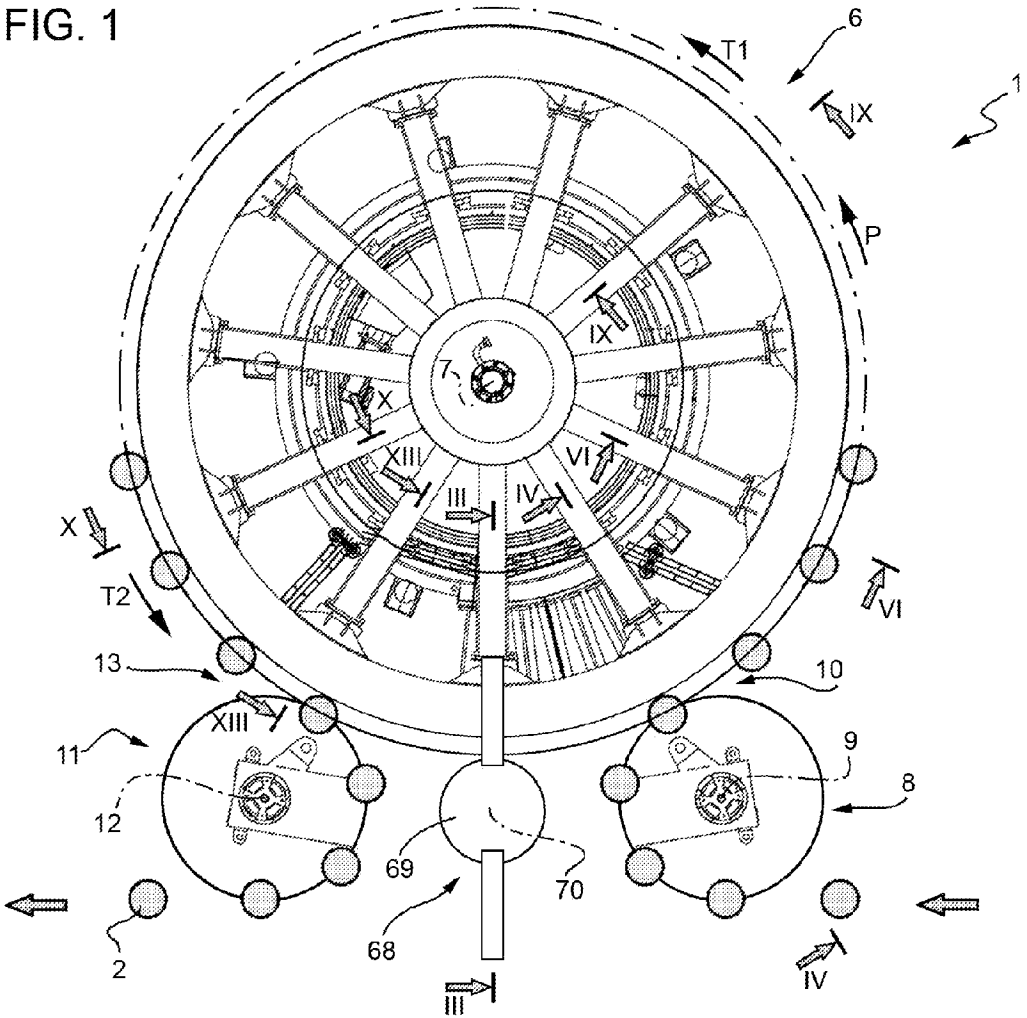
FIG. 1 shows a schematic plan view, with parts removed for clarity, of a preferred embodiment of a machine according to the present invention for filling and capping bottles, in particular glass bottles.
Figure 2:
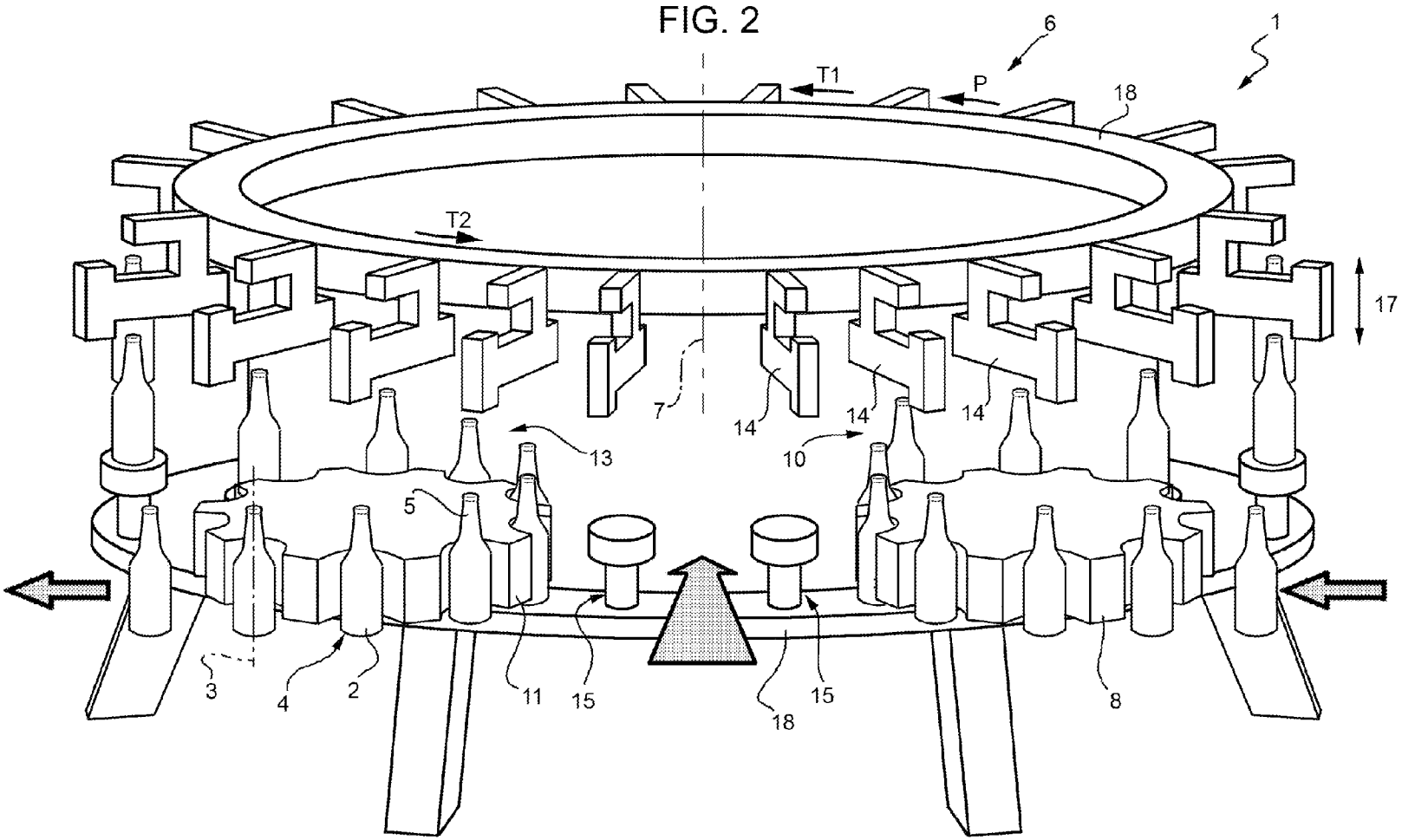
FIG. 2 shows a schematic view in perspective, with parts removed for clarity, of the FIG. 1 machine.

Number 1 in FIGS. 1 and 2 indicates as a whole a machine for bottling liquid, particularly suitable for beer, in glass bottles 2, each of which has a given longitudinal axis 3, is bounded at the bottom by a bottom wall 4 substantially perpendicular to axis 3, and has a top neck 5 substantially coaxial with axis 3.

Each bottle 2 is adapted to be closed by a relative cap 41 basically formed by a metallic disk-shaped body with a peripheral raising rim adapted to be folded and closed on the top end of neck 5.

Machine 1 comprises a conveying device 6 that, according to the invention, serves to fill and cap the bottles 2. In the preferred embodiment as illustrated on the figures, the conveying device 6 comprises a carousel, which is mounted to rotate continuously (anticlockwise in FIG. 1) about a respective substantially vertical longitudinal axis 7 perpendicular to the FIG. 1 plane. The carousel 6 receives a succession of empty bottles 2 from an input wheel 8, which is connected to carousel 6 at a first transfer station 10 and is mounted to rotate continuously about a respective longitudinal axis 9 parallel to axis 7. The carousel 6 releases a succession of full, capped bottles 2 to an output wheel 11, which is connected to carousel 6 at a second transfer station 13 and is mounted to rotate continuously about a respective longitudinal axis 12 parallel to axes 7, 9.

Carousel 6 comprises a number of carry-fill-and-cap units 14, which are equally spaced about axis 7, are mounted along a peripheral edge of carousel 6, and are moved by carousel 6 along a path P extending about axis 7 and through stations 10 and 13.

Figure 3:
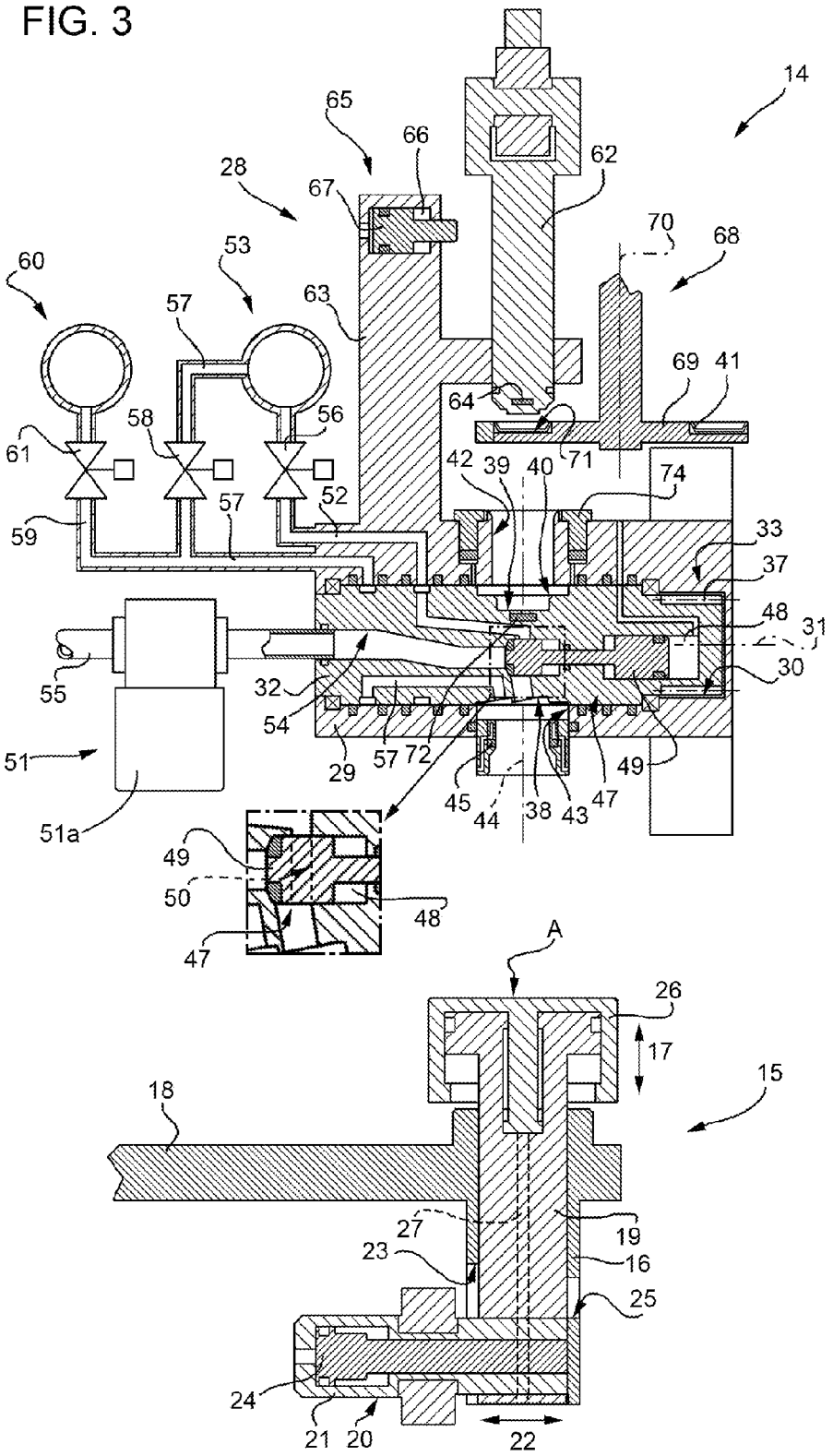
FIG. 3 shows a section along line III-III in FIG. 1.
Figure 6:
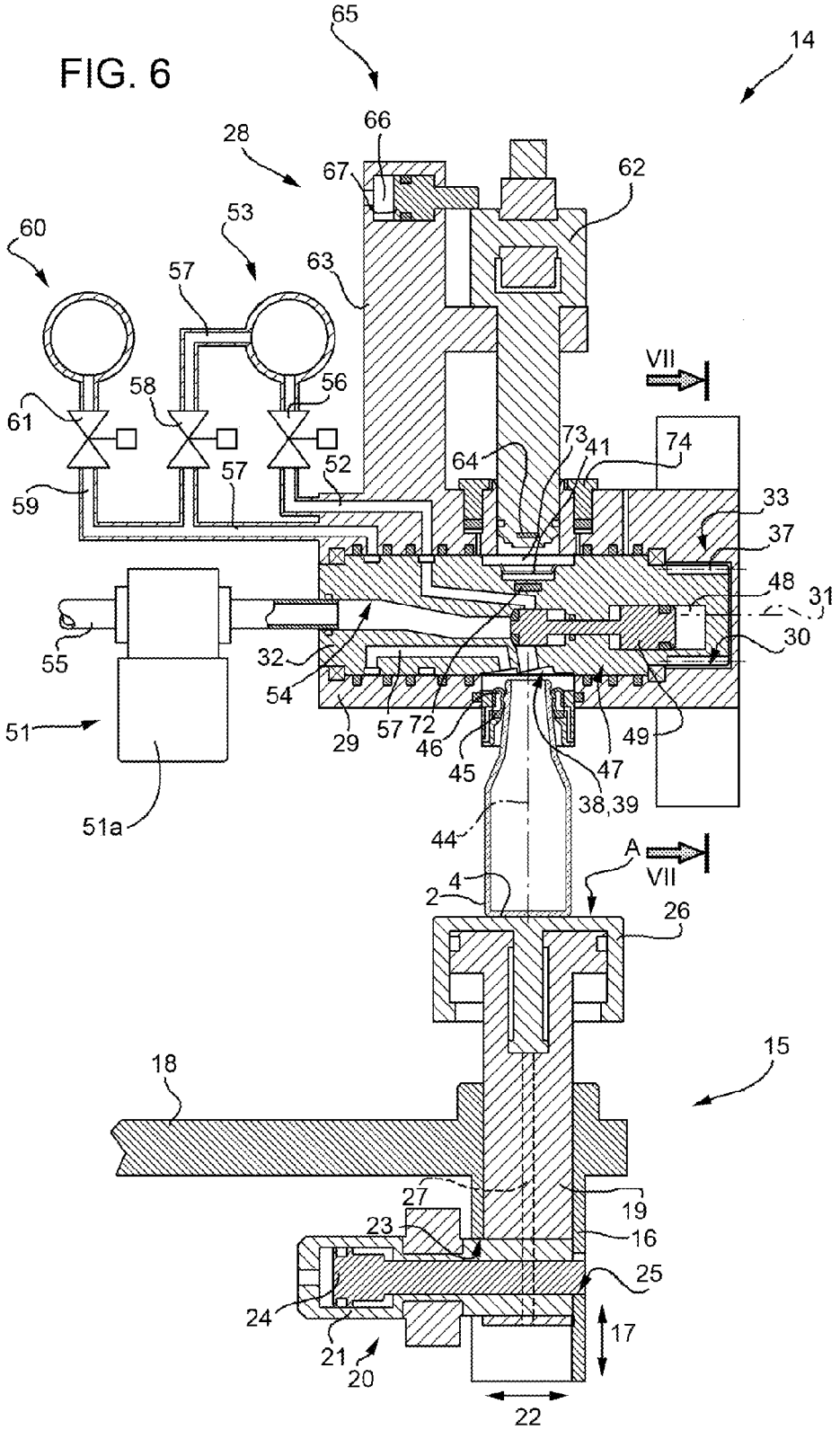
FIG. 6 shows a section along line VI-VI in FIG. 1.
Figure 7:
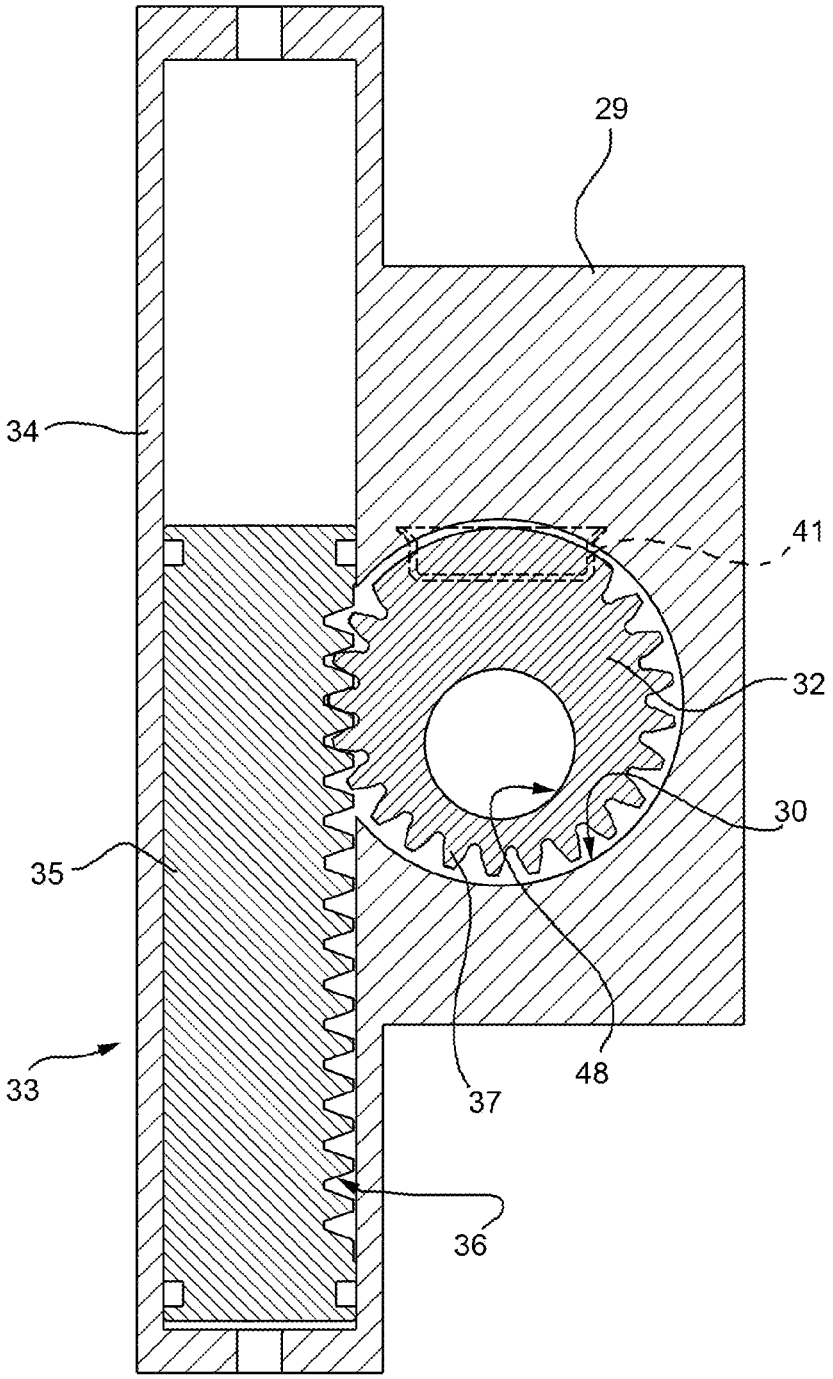
FIG. 7 shows a section along line VII-VII in FIG. 6.
Figure 8:
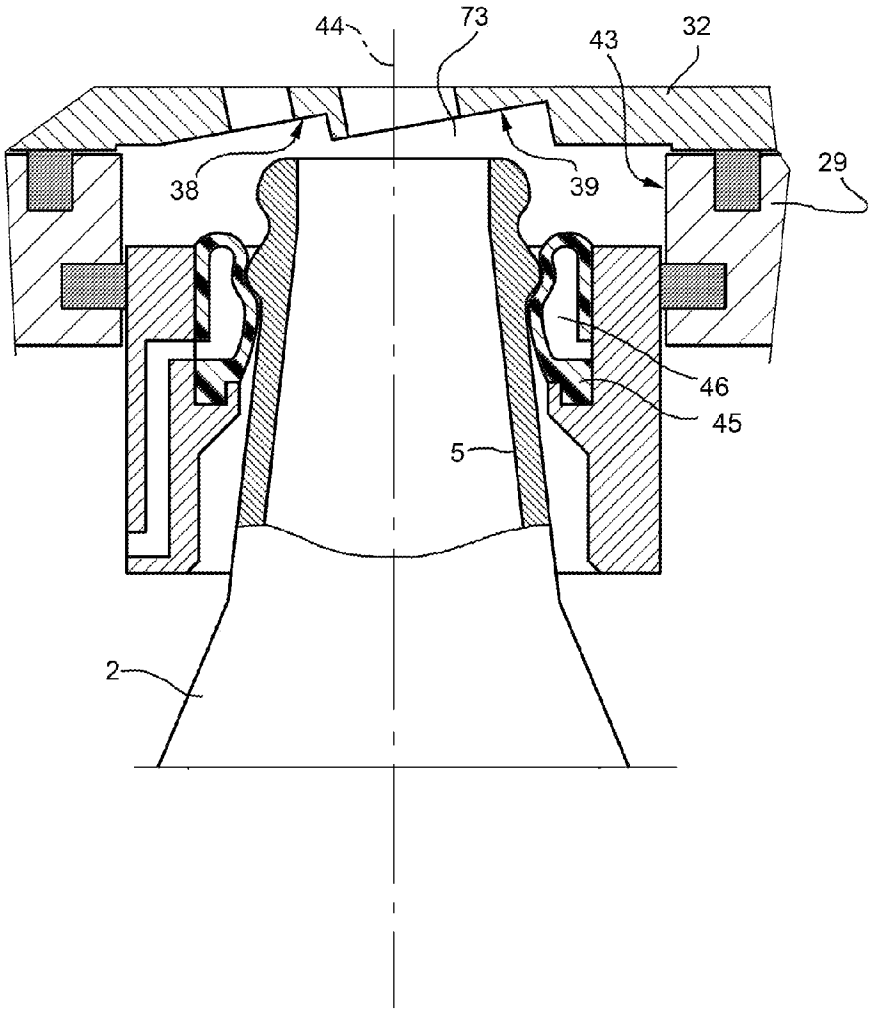
FIG. 8 shows a larger-scale, partly sectioned, schematic view, with parts removed for clarity, of a detail in FIG. 6.

As shown in FIGS. 2 and 3, each unit 14 comprises a conveying device 15 adapted to support the bottom walls 4 of the bottles 2. Supporting device 15 comprises a supporting sleeve 16, which extends in a vertical direction 17 parallel to axes 7, 9 and 12 and is formed through a rotary frame 18 of carousel 6. Sleeve 16 is engaged in sliding manner by a piston 19, which projects outwards from the top of sleeve 16 and is movable in direction 17, with respect to frame 18, by a known actuating device not shown, between a lowered position (FIGS. 3 and 4) and a raised position (FIG. 6).

Piston 19 is locked in the raised position by a lock device 20 comprising a pneumatic actuating cylinder 21, which extends through piston 19 in a radial direction 22 crosswise to direction 17. Cylinder 21 engages in sliding manner a radial opening 23 formed through sleeve 16. Cylinder 21 contains an output rod 24 movable, in direction 22, between a withdrawn release position (FIGS. 3 and 4), in which rod 24 is housed entirely inside cylinder 21, and an extracted lock position (FIG. 6), in which rod 24 projects outwards of cylinder 21 to engage a radial hole 25 formed through sleeve 16.

Device 15 also comprises a plate 26, which is fitted in sliding manner to the top end of piston 19. Plate 26 is movable linearly in direction 17, with respect to piston 19, by a pneumatic actuating device 27 formed partly through piston 19, between a lowered position (FIGS. 3 and 4) and a raised position (FIG. 10), and is bounded at the top by a horizontal surface defining a supporting surface A for a bottle 2.

At its top, each unit 14 also comprises a fill-and-cap head 28, in turn comprising a support block 29, which extends radially outwards of carousel 6 in direction 22. Support block 29 is fixed to frame 18 and has a central hole 30, which has a longitudinal axis 31 parallel to direction 22 and houses a cylindrical bar 32 that is rotated about axis 31 with respect to block 29 by an actuating device 33.

Device 33 comprises a pneumatic actuating cylinder formed, parallel to direction 17, in block 29 and engaged in sliding manner by a piston 35 having a rack meshing with a sprocket 37 formed on the outer surface of bar 32, coaxially with axis 31.

Bar 32 has an annular cavity 38, which is formed at an intermediate point along the outer surface of bar 32. Cavity 38 extends about axis 31 and is bounded by a bottom wall 39 defining a seat 40 for a cap 41 of a bottle 2. Cavity 38 further communicates with the outside via a top opening 42 and a bottom opening 43 opposite each other, and which are substantially cylindrical, are formed through block 29 in direction 17, and have a longitudinal axis 44 parallel to direction 17.

In connection with the above, it should be pointed out that the bottom opening 43 faces plate 26 and has an annular seal 45, which is fixed to the inner surface of this opening 43, coaxially with axis 44. An annular chamber 46, which is formed in seal 45 is connectable to a known pneumatic compressed-air device not shown.

Bar 32 also houses an on-off valve 47 comprising a central hole 48 formed, parallel to direction 22, in bar 32 and engaged in sliding manner by a shutter 49, which has a conduit 50 formed through shutter 49 in direction 17. On-off valve 47 selectively connects cavity 38 to a liquid feed device 51 comprising a volumetric flow meter 51*a*, and to a delivery branch 52 of a carbon dioxide feed device 53.

Device 51 also comprises a feed conduit 54 formed through bar 32 and connected to a liquid tank (not shown) by a feed conduit 55 inserted in a rotating arrangement inside conduit 54 to allow rotation of conduit 54 with respect to conduit 55.

Branch 52 has an on-off valve 56. Said branch 52 is formed partly through block 29 and partly through bar 32, and forms a part of device 53. Device 53 also comprises a return branch 57, which is formed partly through bar 32 and partly through block 29. Device 53 has an on-off valve 58. Device 53 communicates with cavity 38, and is connected to a conduit 59 of a pneumatic suction device 60 having an on-off valve 61 along conduit 59.

Head 28 also supports an elongated gripping member 62, which extends in direction 17, coaxially with axis 44, and is fitted in sliding manner through a supporting bracket 63 projecting upwards from block 29. Further, gripping member 62 is movable linearly in direction 17 and with respect to bracket 63 by a known actuating device not shown. A magnet 64 is fitted inside the bottom end of member 62 to enable member 62 to pickup and retain a cap 41.

Figure 4:
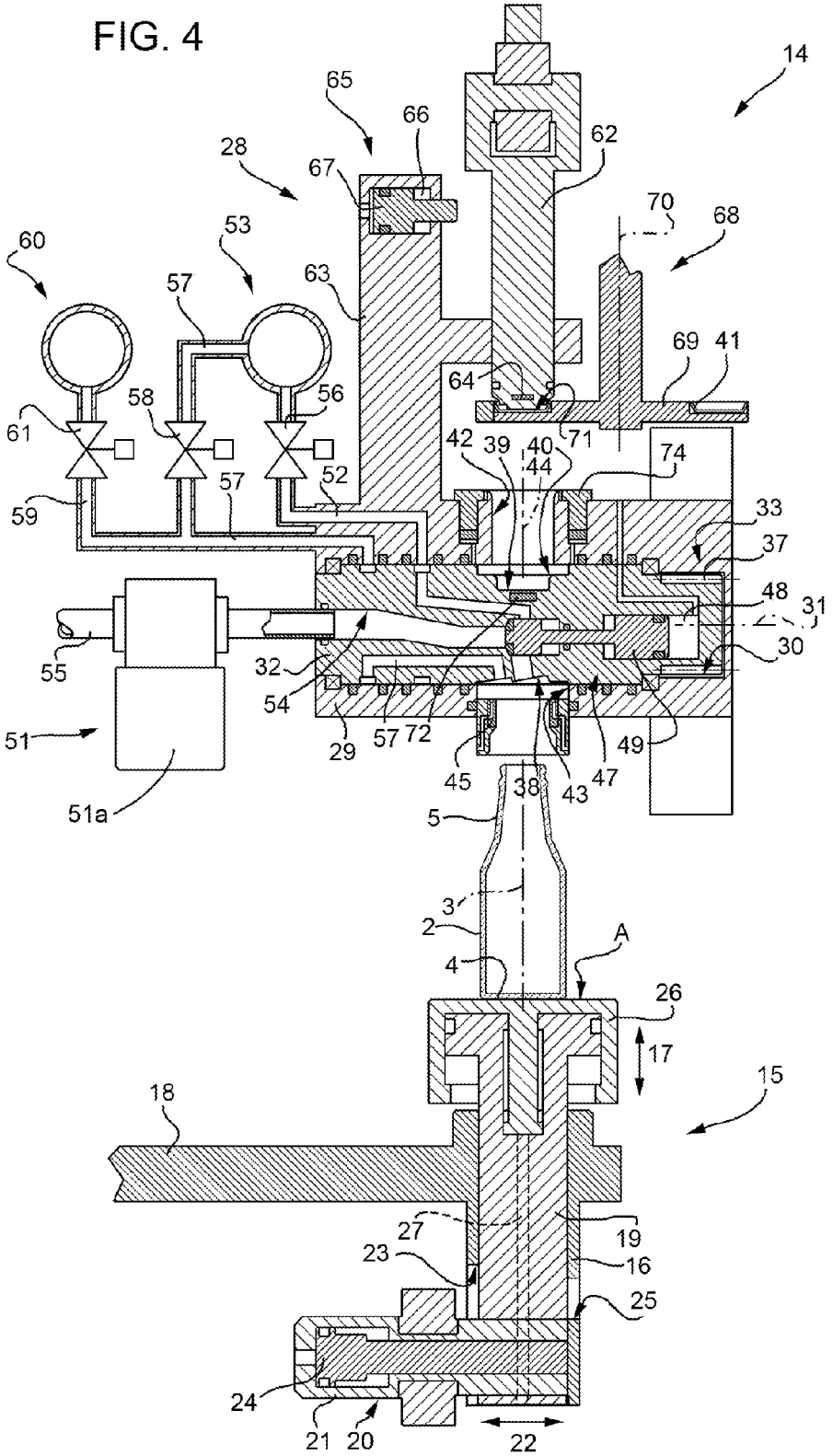
FIG. 4 shows a section along line IV-IV in FIG. 1.

Member 62 is movable in direction 17 between a raised position (FIGS. 3 and 4) and a lowered position (FIG. 6), and is locked in the lowered position by a lock device 65. Locking device 65 comprises an actuating cylinder 66, which is formed, parallel to direction 22, in bracket 63, and an output rod 67 movable in direction 22 within cylinder 66 between an extracted lock position (FIG. 6), in which rod 67 engages the top of member 62, and a withdrawn release position (FIGS. 3 and 4).

Caps 41 are fed to members 62 by a feed device 68, which is mounted between stations 10 and 13, downstream from station 13 in the direction of rotation of carousel about axis 7. Feed device 68 comprises a dispenser disk 69, which is mounted to rotate about a respective longitudinal axis 70 parallel to axis 7 and extends between blocks 29 and members 62. Dispenser disk 69 has a number of pockets 71 equally spaced about axis 70 and each for receiving and retaining a respective cap 41 with its concavity facing upwards.

Figure 5:
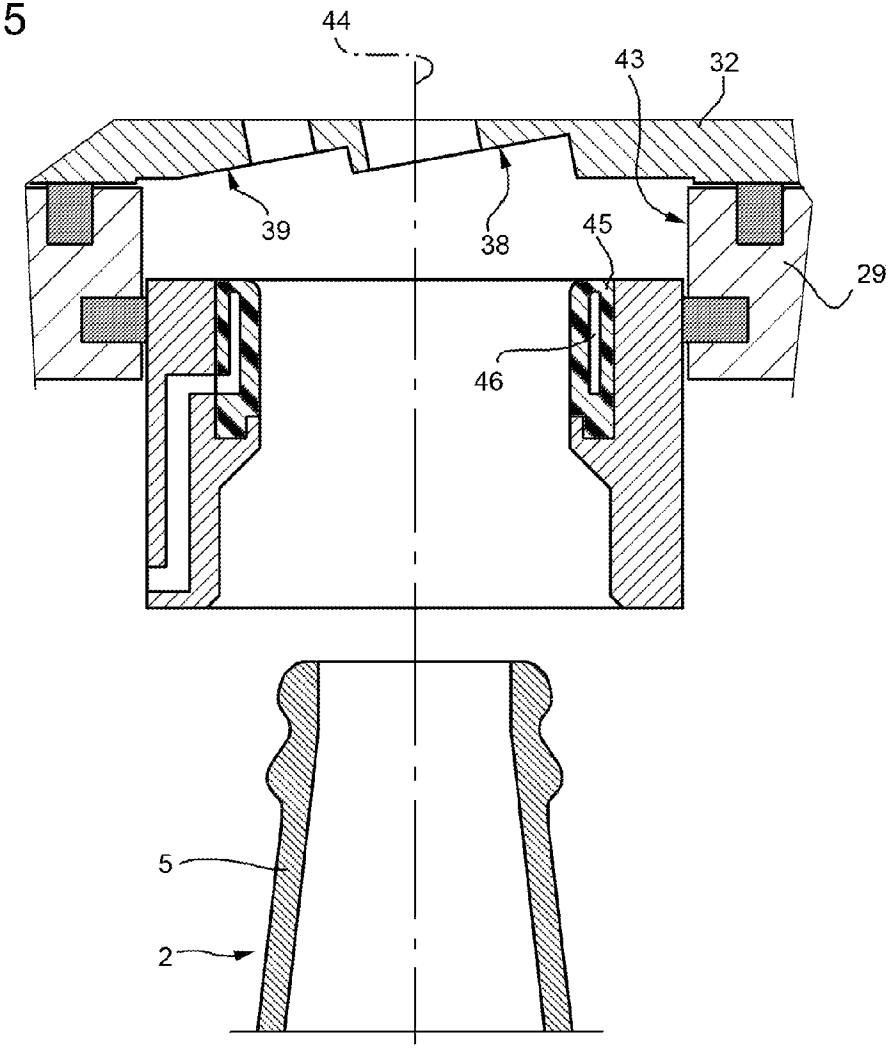
FIG. 5 shows a larger-scale, partly sectioned, schematic view, with parts removed for clarity, of a detail in FIG. 4.

Operation of machine 1 will now be described with reference to FIGS. 3 to 13, with reference to the filling and capping of one bottle 2, and therefore to one unit 14, and as of the instant in which (FIG. 3):

rod 67 of lock device 65 and rod 24 of lock device 20 are both in the withdrawn release position;

gripping member 62 is in the raised position;

piston 19 and plate 26 are both in the lowered position;

shutter 49 is positioned so that it closes conduit 54 and opening branch 52;

valves 56, 58 and 61 are closed;

bar 32 is set to a given angular position about axis 31, with seat 40 facing top opening 42; and the pneumatic compressed-air device (not shown) connected to chamber 46 of seal 45 is deactivated (FIG. 5).

With reference to FIG. 4, the unit 14 in question is first fed through feed device 68 in time with a pocket 71, to allow member 62 to move down and magnet 64 to pick up respective cap 41, and is then fed through transfer station 10 in time with a bottle 2, which is fed by input wheel 8 onto supporting surface A of plate 26.

As shown in FIG. 6, piston 19 is raised in direction 17 to move bottle 2 through bottom opening 43; rod 24 of lock device 20 is moved into the extracted lock position; the pneumatic compressed-air device (not shown) connected to chamber 46 is activated to connect bottle 2 in fluidtight manner to seal 45 (FIG. 8); member 62 is lowered in direction 17 through top opening and connected to this opening 42 in fluidtight manner; rod 67 of lock device 65 is moved into the extracted lock position; and cap 41 is transferred from member 62 into seat 40 by a magnet 72 fitted inside bar 32 at seat 40 and designed to attract cap 41 more strongly than magnet 64.

Fluidtight connection of bottle 2 to bottom opening 43 and of member 62 to opening 42 seals off cavity 38 and forms a chamber 73 completely isolated from the outside.

Once chamber 73 is formed, bottling the liquid comprises a number of preliminary operations, which are performed prior to filling bottle 2 and as soon as valves 56, 58 and 61 are closed, which, in the example shown, comprises:

a first air-extraction operation to remove the air from bottle 2 by opening valve 61 and keeping valves 56 and 58 closed;

flushing bottle 2 by opening valves 56 and 61, keeping valve 58 closed, and feeding a stream of carbon dioxide first along delivery branch 52, then through bottle 2, and finally along return branch 57 and conduit 59;

possibly a second air-extraction operation to remove any remaining air from bottle 2 by opening valve 61 and keeping valves 56 and 58 closed; and pressurizing bottle 2 by opening valve 56, keeping valves 58 and 61 closed, and feeding a stream of carbon dioxide into chamber 73 and bottle 2.

In connection with the above, it should be pointed out that, in the example shown, the pressure in chamber 73 and bottle 2 following pressurization is such that it allows fill bottle 2 by the liquid falling by gravity from the tank (not shown) into bottle 2.

Figure 9:
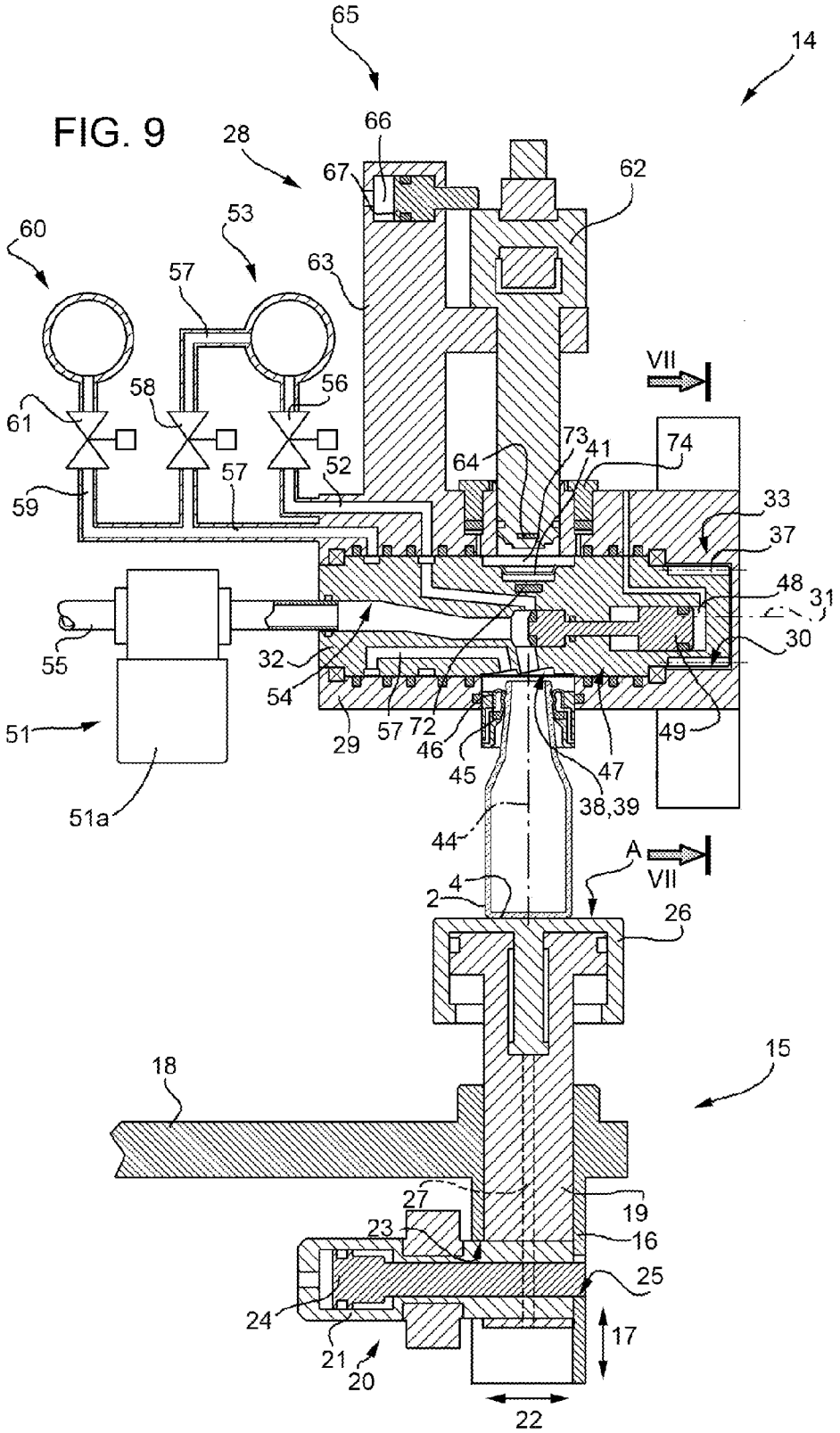
FIG. 9 shows a section along line IX-IX in FIG. 1.

As shown in FIG. 9, valve 58 is opened; valves 56 and 61 are kept closed; shutter 49 is moved into position closing branch 52 and opening conduit 54 to fill bottle 2 and discharge the carbon dioxide from bottle 2 along branch 57 and through valve 58; and valve 58 is moved back into the closed position once bottle 2 is filled.

Figure 10:
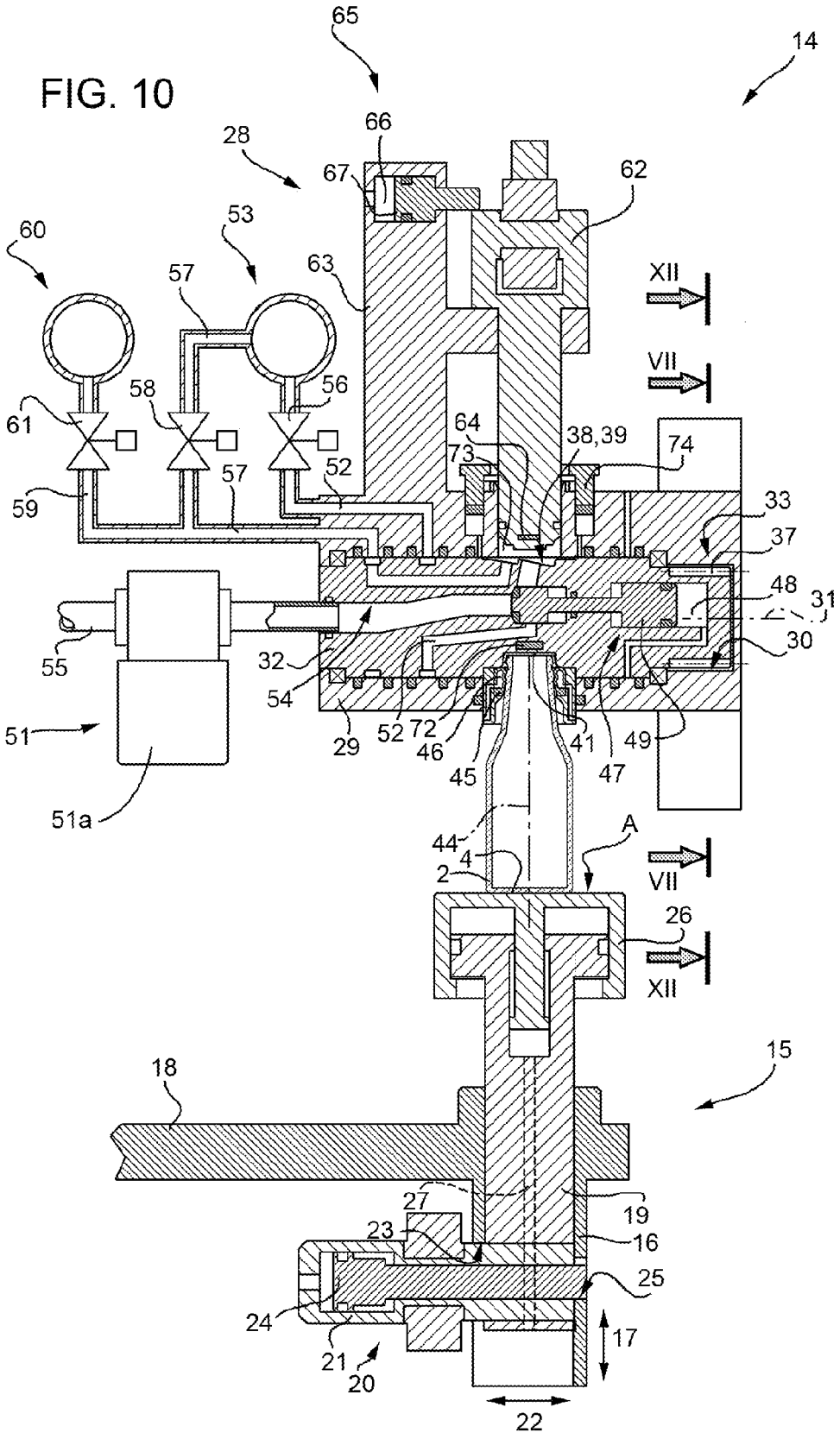
FIG. 10 shows a section along line X-X in FIG. 1.
Figure 11:
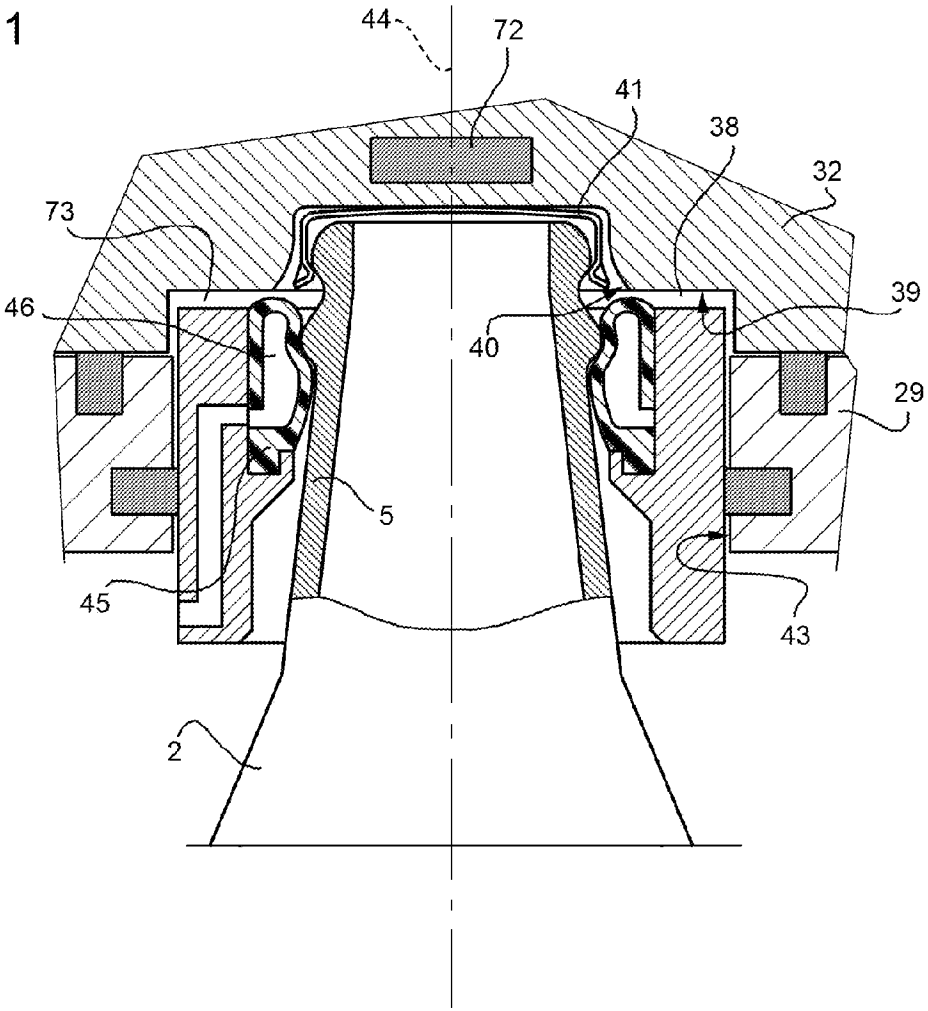
FIG. 11 shows a larger-scale, partly sectioned, schematic view, with parts removed for clarity, of a detail in FIG. 10.
Figure 12:
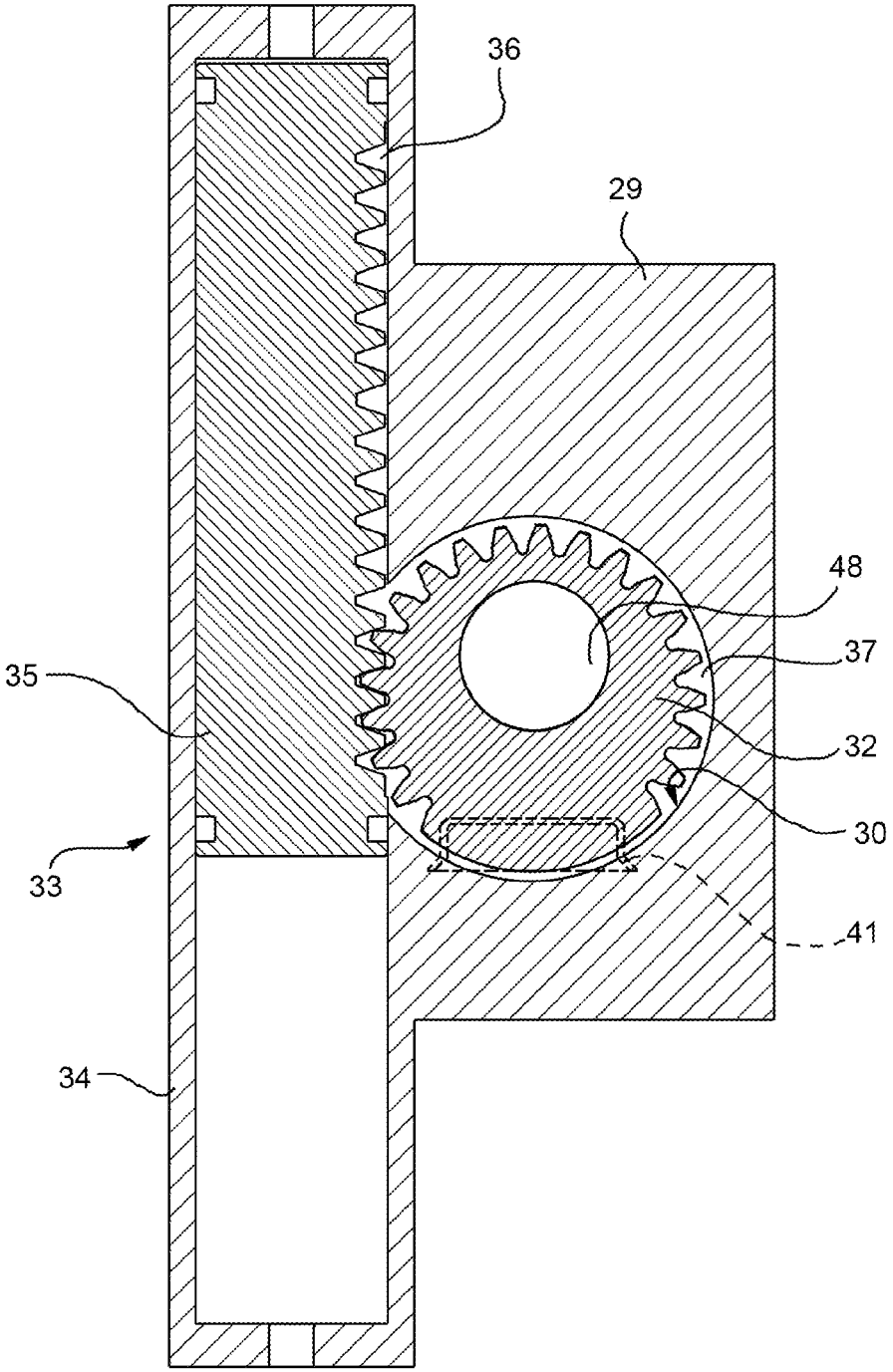
FIG. 12 shows a section along line XII-XII in FIG. 10.

With reference to FIGS. 10, 11 and 12, valves 56, 58 and 61 are kept closed; shutter 49 is moved back into a position opening branch 52 and closing conduit 54; piston 35 of actuating device 33 is raised in direction 17 to move bar 32 about axis 31, and seat 40 and cap 41 as a whole into a position facing bottom opening 43 and bottle 2; and plate 26 is raised in direction 17 to move bottle 2 inside chamber 73 and against cap 41 to cap bottle 2.

In connection with the above, it should be pointed out that:

the upward thrust exerted by plate 26 on bottle 2 is greater than the grip exerted by seal 45 on neck 5 of bottle 2;

bottle 2 is capped inside chamber 73, i.e. inside a chamber sealed off from the outside and at a given pressure due to the presence of carbon dioxide; and when bottle 2 is raised, the volume of chamber 73 is maintained substantially constant by the movement of a movable wall 74 having a collar-like shape, which extends about opening 42, coaxially with axis 44, and forms a part of an outer wall of chamber 73. Further, movable wall 74 communicates pneumatically with cavity 38, is fitted in sliding manner to block 29, and is raised in direction 17 with respect to block 29 by the carbon dioxide inside chamber 73.

Figure 13:
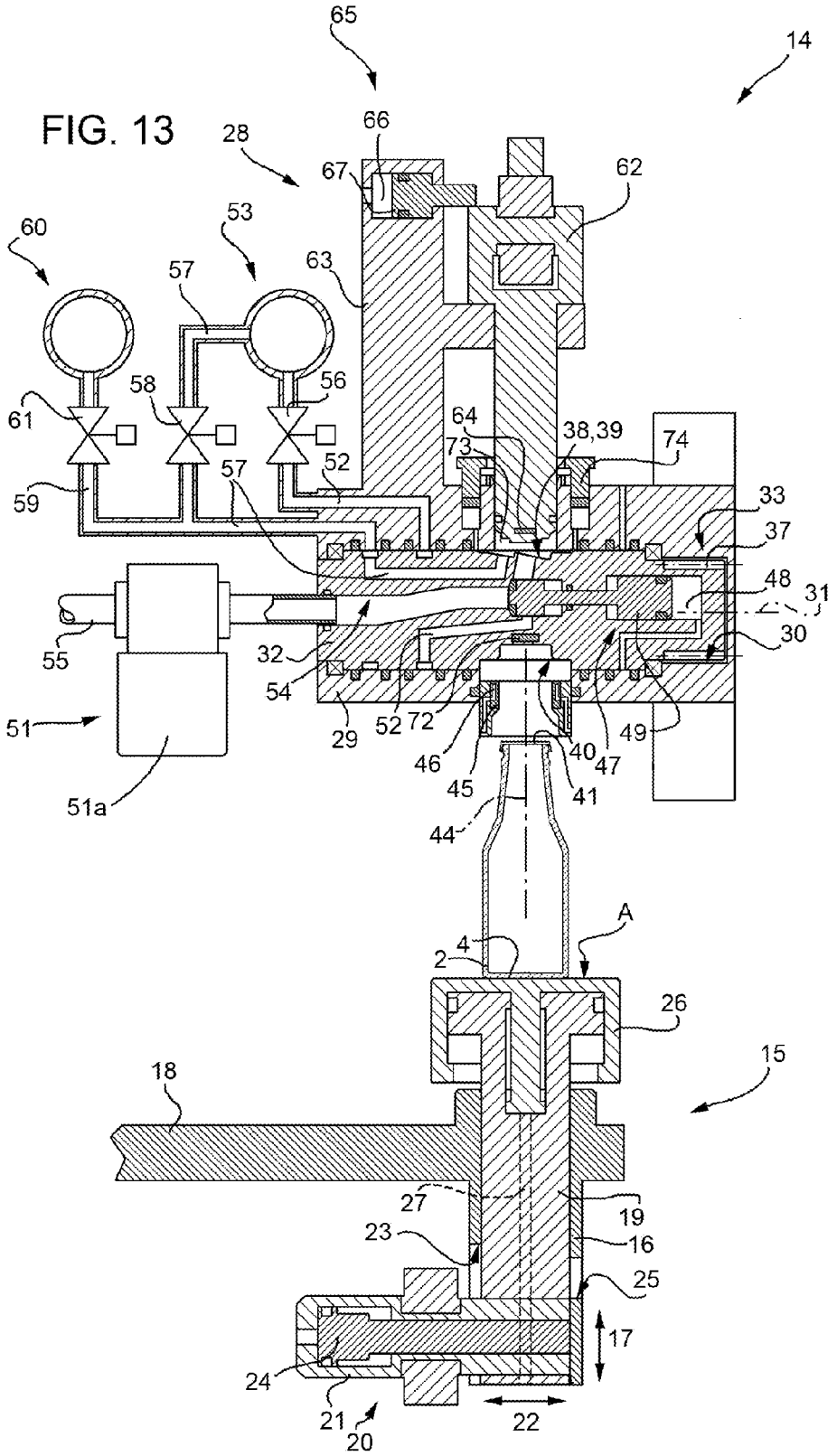
FIG. 13 shows a section along line XIII-XIII in FIG. 1.

Finally, as shown in FIG. 13, valve 61 is opened to discharge the remaining carbon dioxide from chamber 73; the pneumatic compressed-air device (not shown) connected to chamber 46 of seal 45 is deactivated; and piston 19 and plate 26 are lowered in direction 17 to release bottle 2 from fill-and-cap head 28.

Machine 1 therefore has several advantages, mainly due to the fact that:

bottles 2 are filled with liquid in the presence of carbon dioxide and in the absence of oxygen, in particular in the neck space of bottles 2, which is very advantageous in the case of beer bottles;

bottles 2 are filled along a first portion T1 of path P and capped along a second portion T2 of path P, while remaining in the same unit 14 at all times, and only being transferred from carousel 6 to wheel 11 after being capped with respective caps 41;

the volume of liquid inside bottles 2 is relatively precise;

the diameter of output wheel 11 is relatively small and substantially equal to the diameter of input wheel 8, on account of bottles 2 being transferred already capped to output wheel 11, which may therefore be rotated about axis 12 at relatively high speed (any product spillage due to centrifugal force is completely eliminated because bottles 2 are leaving machine 1 already capped);

decompression and skimming normally performed on known bottling systems are eliminated.

Machine 1 may be used for bottling any type of liquid, in particular a carbonated liquid, in glass or plastic bottles or even in combined cardboard-plastic bottles or containers.

Figure 15:
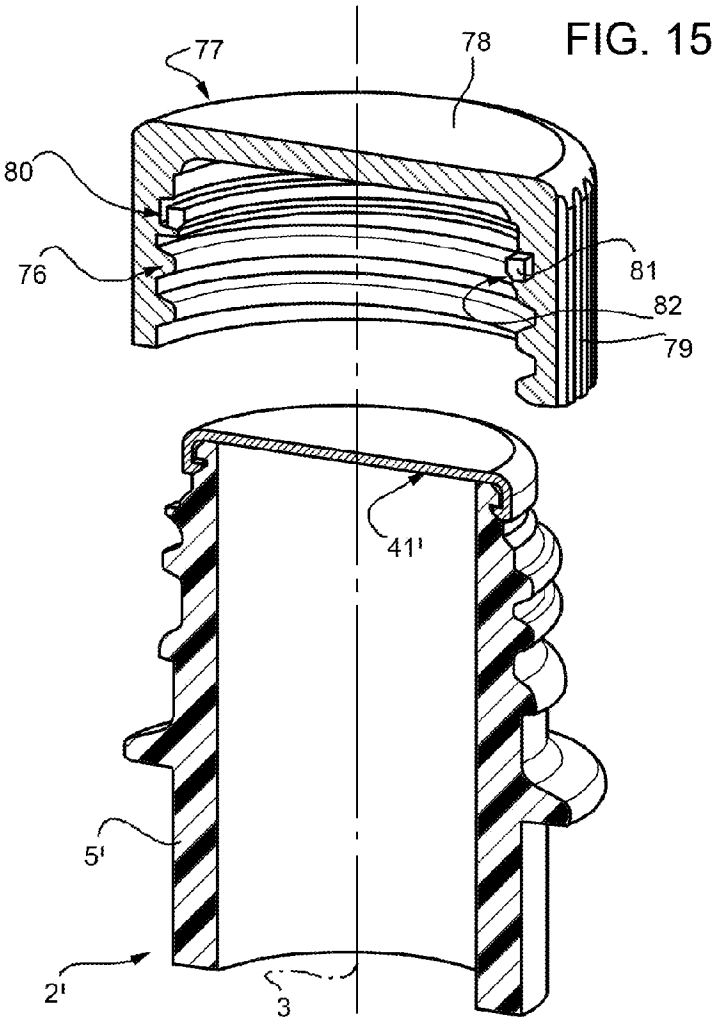
FIGS. 14 to 17 show partly sectioned perspective views of a possible variant of bottles suitable to be processed by the FIG. 1 machine.
Figure 14:
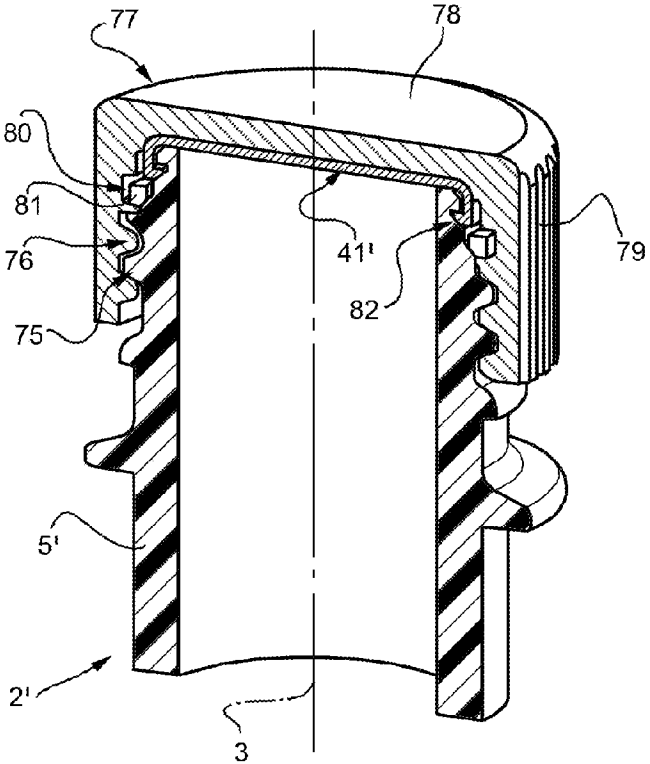

FIGS. 14 and 15 show another type of bottle, indicated as a whole with 2', which can be filled and capped on machine 1. Bottle 2' and the other components fitted thereto will be described in the following paragraphs insofar as they differ from the corresponding ones already described and using the same references, where possible, for identical or equivalent parts.

In particular, bottle 2' has an axis 3 and comprises a neck 5', externally provided with a thread 75 adapted to be engaged by a corresponding inner thread 76 of a screw cap 77 in the finished configuration in which it reaches the final user.

During the operating steps performed on machine 1, bottle 2', in a way completely identical to the one described with reference to bottle 2, is capped with a relative cap 41', which is preferably made of a plastic material and has a shape similar to the one of caps 41, i.e. formed by a disk-shaped body with a peripheral raising rim.

In practice, each bottle 2' exiting from machine 1 is provided with a relative cap 41' having the disk-shaped body closing the open top end of neck 5' and the peripheral raising rim folded and closed onto the neck top edge (FIG. 15). This kind of configuration of caps 41' is designed for standing relatively high pressures, for instance up to 5 bar.

Differently from what happens with metallic caps 41 onto glass bottles 2, caps 41' cannot define a permanent closure of plastic bottles 2'. For this reason, a further step is performed onto each bottle 2', namely the application of a relative screw cap 77, which is fitted onto neck 5' so as to obtain engagement of relative threads 75 and 76.

More specifically, cap 77 has a disk-shaped top portion 78 and a cylindrical lateral wall 79 internally provided with thread 76.

Advantageously, cap 77 further comprises coupling means 80 to engage and pull cap 41' along axis 3 upon removal of the cap 77 from neck 5' so as to open bottle 2'.

In the embodiment shown in FIGS. 14 and 15, coupling means 80 comprise an elastic ring 81, preferably a Seeger ring, held inside lateral wall 79 by thread 76; during engagement of threads 75 and 76, elastic ring 21 is forced to deform elastically in a radial direction so as to overcome cap 41', whilst, during removal of cap 77 from bottle 2', it is driven by cap 77 to exert an axial thrust on the peripheral rim of cap 41' from below so as to engage it and detach the cap 41' from neck 5' along axis 3. It should be noted that, during the engagement of threads 75 and 76, the passage of elastic ring 81 from above to below cap 41' is made possible not only by the elastic deformation of the ring 81 but also through a slight elastic deformation of the plastic material forming the cap 41'.

In order to perform the above actions, elastic ring has a conical inner surface 82 with a diameter decreasing towards top portion 78 of cap 77 or, in equivalent manner, increasing towards the bottom end of lateral wall 79.

Figure 17:
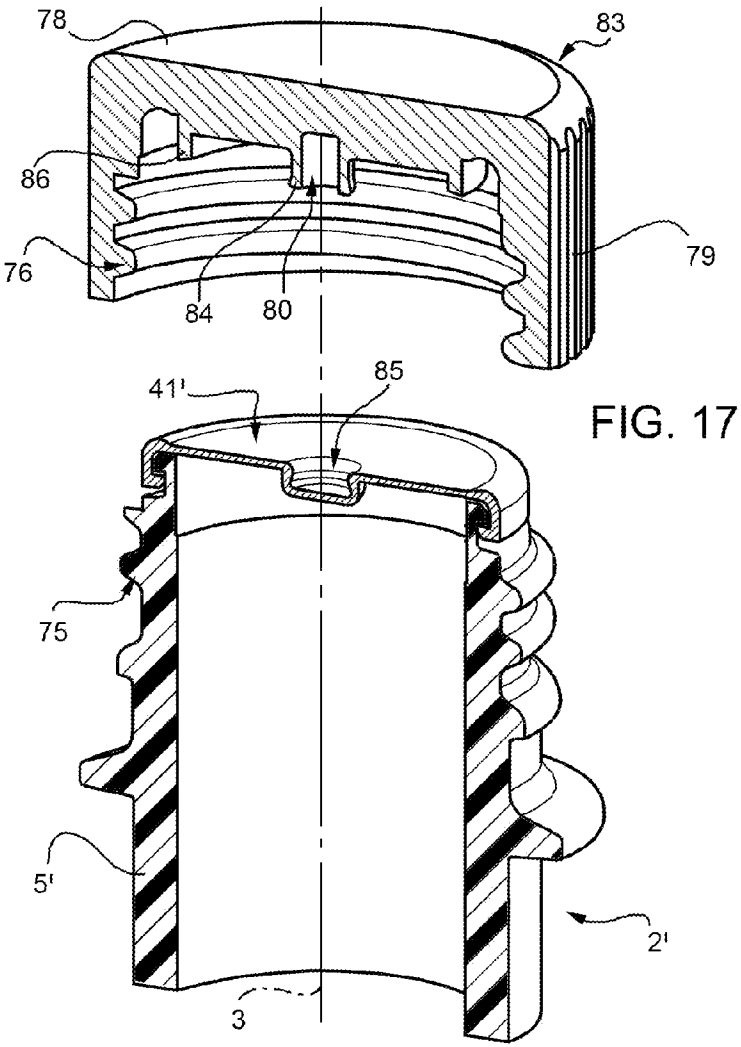
Figure 16:
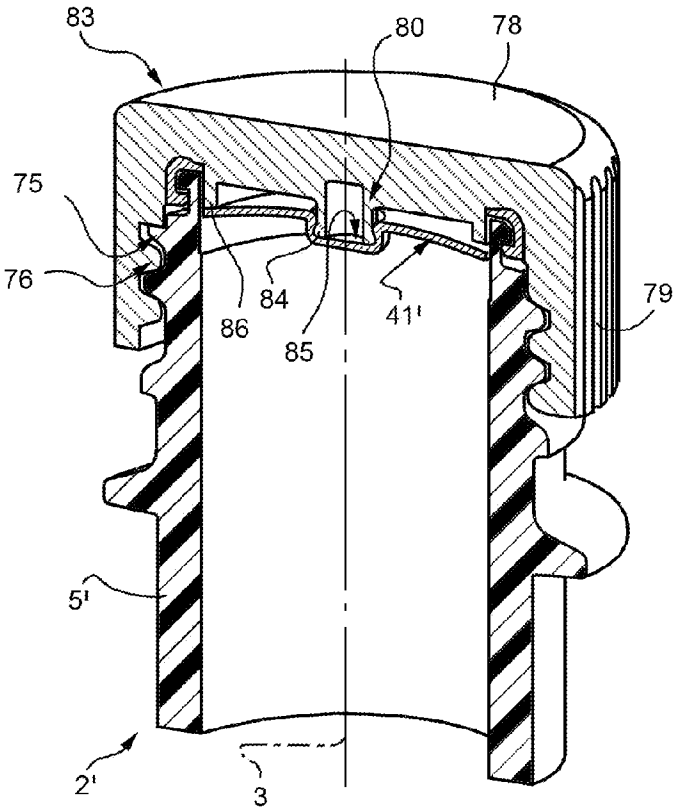

In FIGS. 16 and 17, number 83 indicates as a whole a possible variant of a screw cap for permanently closing bottle 2'; cap 83 will be described in the following paragraphs insofar as it differs from cap 77 and using the same references, where possible, for identical or equivalent parts.

In particular, in this solution, coupling means 80 comprise a retaining projection 84 extending along axis 3 from a central part of disk-shaped top portion 78 of cap 83 and adapted to engage a corresponding seat 85 provided on top surface of cap 41'. More specifically, projection 84 has a tubular shape with a bottom edge slightly protruding outwards so as "to hook" the lateral wall delimiting seat 85 of cap 41'.

Cap 83 further comprises an annular cutting ridge 86, which axially projects from the bottom surface of disk-shaped top portion 78 in a position radially interposed between projection 84 and lateral wall 79, and which is adapted to cut cap 41' close to its peripheral rim when the cap 83 is fitted to bottle 2'.

In the shown case, the cutting action on cap 41' is performed in a position radially inner with respect to the top edge of bottle 2' and such that ridge 86, after cutting, defines an inner sealing of the bottle neck 5'. (FIG. 16).

According to a possible alternative not shown, the cutting action on cap 41' may be also performed in a position radially outer with respect to the top edge of bottle 2'.

In the light of the above, it is evident that the solution of closure systems shown in FIGS. 14 to 17 make machine 1 suitable to process not only glass bottles but even plastic or combined cardboard-plastic bottles or containers.

The invention claimed is:

1. A method of bottling liquids, in particular carbonated liquids or liquids sensitive to oxygen, on a machine comprising a conveying device movable along a given path and having at least one unit for receiving and retaining a bottle, wherein the machine comprises, for each said unit, a respective fill-and-cap head movable along the given path and comprising a cavity having a first opening facing the unit and a movable wall having a collar shape and slidable to laterally limit part of said cavity, the method comprising:

filling the bottle with a liquid as the unit travels along a first portion of the given path;

capping the bottle with a cap as the same unit travels along a second portion of the given path;

moving the bottle through the first opening to close the cavity in fluidtight manner and define a chamber;

connecting the chamber to a feed device for feeding the liquid into the bottle moving the cap inside the chamber and into position facing the bottle;

moving the bottle through the first opening and against the cap to cap the bottle inside the chamber feeding a pressurized gas into the chamber before capping the bottle with the cap; and sliding the movable wall when capping the bottle to maintain a substantially constant volume of the chamber.

2. A method as claimed in claim 1, wherein the cavity has a second opening facing a gripping member for gripping the cap the method also comprising:

feeding the cap to the gripping member; and moving the gripping member and the cap as a whole through the second opening to fluidtight seal the cavity and define said chamber.

3. A method as claimed in claim 2, wherein the cavity is substantially annular and bounded by a bottom wall defining a seat for receiving and retaining the cap, the method comprising: transferring the cap from the gripping member into said seat; and rotating the bottom wall to move the cap into position facing the bottle.

4. A method as claimed in claim 1, and also comprising:

selectively connecting the chamber to a pneumatic suction device and to a feed device for feeding pressurized gas into the bottle.

5. A method as claimed in claim 1, and also comprising:

applying, onto a neck of said bottle, a further cap provided with coupling means to engage and pull said cap along the bottle axis upon removal of said further cap from said neck so as to open said bottle.

6. A method as claimed in claim 5, wherein said further cap is a screw cap, and wherein said step of applying comprises the step of engaging a thread of said screw cap with a thread of said neck.

7. A method as claimed in claim 5, wherein said applying comprises cutting said cap close to its peripheral edge by cutting means carried by said further cap and upon fitting said further cap onto said neck.

8. A machine for bottling liquids, in particular carbonated liquids, the machine comprising:

a conveying device having at least one unit for receiving and retaining a bottle and which is fed by the conveying device along a given path;

a feed device for feeding the liquid into the bottle as the unit travels along a first portion of the given path;

a fill-and-cap head for capping the bottle with a cap as the unit travels along a second portion of the given path, wherein the fill-and-cap head is movable along the path and having a cavity having a first opening facing the unit, the fill-and-cap head comprising a movable wall having a collar shape and slidable to laterally limit part of the cavity and is movable when the bottle is moved inside the cavity to maintain a substantially constant volume of the cavity; and a feed device for feeding the cap into the chamber and into position facing the bottle;

wherein the unit is movable crosswise to the path to move the bottle through the first opening to seal the cavity in fluidtight manner and define a chamber connectable to said feed device for feeding the liquid into the bottle.

9. A machine as claimed in claim 8, wherein the cavity has a second opening; the fill-and-cap head also comprising a gripping member for gripping the cap, and which faces the second opening and is movable through the second opening to fluidtight seal the cavity and define said chamber.

10. A machine as claimed in claim 9, wherein the cavity is substantially annular and bounded by a bottom wall defining a seat for receiving the cap from the gripping member.

11. A machine as claimed in claim 10, wherein the bottom wall is mounted to rotate about a respective longitudinal axis and move said seat between a first operating position, in which the seat faces the gripping member, and a second operating position, in which the seat faces the bottle.

12. A machine as claimed in claim 9, wherein the conveying device comprises a conveyor carousel, which is mounted to rotate about a respective further longitudinal axis, is movable along said path, comprises a number of said seats, and comprises, for each unit, a respective said fill-and-cap head.

13. A machine as claimed in claim 8, and also comprising a pneumatic suction device, and a feed device for feeding pressurized gas into the bottle; the chamber being connectable selectively to said pneumatic suction device and said feed device for feeding pressurized gas into the bottle.

14. A machine as claimed in claim 8, wherein said bottle also comprises a further cap applied onto a neck of said bottle and provided with coupling means to engage and pull said cap along the bottle axis upon removal of said further cap from said neck so as to open the bottle.

15. A machine as claimed in claim 14, wherein said further cap is a screw cap screwed onto a thread of said neck.

16. A machine as claimed in claim 14, wherein said further cap also comprises cutting means adapted to cut said cap close to its peripheral edge when said further cap is fitted onto said neck.

* * * * *